US011791584B2

(12) United States Patent
Miyamura et al.

(10) Patent No.: US 11,791,584 B2
(45) Date of Patent: Oct. 17, 2023

(54) CONNECTOR HAVING IMPROVED HOLDING FORCE FOR RETAINER

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Tetsuya Miyamura, Mie (JP); Masakuni Kasugai, Mie (JP); Masanori Moriyasu, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 208 days.

(21) Appl. No.: 17/413,503

(22) PCT Filed: Dec. 6, 2019

(86) PCT No.: PCT/JP2019/047872
§ 371 (c)(1),
(2) Date: Jun. 11, 2021

(87) PCT Pub. No.: WO2020/137454
PCT Pub. Date: Jul. 2, 2020

(65) Prior Publication Data

US 2022/0029339 A1 Jan. 27, 2022

(30) Foreign Application Priority Data

Dec. 27, 2018 (JP) ..... 2018-244569

(51) Int. Cl.
*H01R 13/436* (2006.01)

(52) U.S. Cl.
CPC ..... *H01R 13/4367* (2013.01)

(58) Field of Classification Search
CPC ..... H01R 13/6271; H01R 13/6272; H01R 13/4223; H01R 13/4362; H01R 13/4367; H01R 13/73
See application file for complete search history.

(56) References Cited

U.S. PATENT DOCUMENTS 4,867,711 A * 9/1989 Yuasa ..... H01R 13/4362 439/744
5,252,096 A * 10/1993 Okada ..... H01R 13/4362 439/752

(Continued)

FOREIGN PATENT DOCUMENTS

JP H10-112345 A 4/1998
JP H11-067318 A 3/1999

(Continued)

OTHER PUBLICATIONS

International Search Report dated Mar. 3, 2020 for WO 2020/137454 A1 ( pages).

*Primary Examiner* — Thanh Tam T Le
(74) *Attorney, Agent, or Firm* — Venjuris, P.C.

(57) ABSTRACT

It is aimed to improve a holding force for holding a retainer on a housing. A female connector (F) includes a female housing (10), female terminal fittings (27) to be inserted into the female housing (10) from behind, and a retainer (36) mounted on the female housing (10). The retainer (36) is movable in a direction intersecting an inserting direction of the female terminal fittings (27) between a partial locking position where insertion of the female terminal fittings (27) into the female housing (10) is allowed and a full locking position where the female terminal fittings (27) inserted into the female housing (10) are retained. The female housing (10) is formed with displacement restricting portions (18).

(Continued)

The retainer (36) is formed with hooking portions (43) capable of coming into contact with the displacement restricting portions (18) from front when the retainer (36) is at the full locking position.

5 Claims, 14 Drawing Sheets

(56) References Cited

U.S. PATENT DOCUMENTS 5,299,958 A * 4/1994 Ohsumi ..... H01R 13/4362 439/752
5,437,565 A * 8/1995 Atsumi ..... H01R 13/4362 439/752
5,464,356 A * 11/1995 Nebeshima ..... H01R 13/4362 439/752
5,755,600 A * 5/1998 Yoshida ..... H01R 13/4362 439/752
5,797,772 A * 8/1998 Sakurai ..... H01R 13/4362 439/752
5,848,919 A * 12/1998 Nagano ..... H01R 13/4362 439/752
5,851,128 A * 12/1998 Nakata ..... H01R 13/434 439/752
5,885,105 A * 3/1999 Takagishi ..... H01R 13/4362 439/595
5,980,333 A 11/1999 Nakamura et al.
10,063,000 B2 * 8/2018 Nishide ..... H01R 13/4362
10,109,955 B2 * 10/2018 Holub ..... H01R 13/64
10,218,112 B2 * 2/2019 Lüttermann ..... H01R 13/506
10,644,429 B2 * 5/2020 Masada ..... H01R 13/518

FOREIGN PATENT DOCUMENTS

JP 2005-209400 A 8/2005
JP 2008-186739 A 8/2008
JP 2008-198554 A 8/2008

* cited by examiner

CONNECTOR HAVING IMPROVED HOLDING FORCE FOR RETAINER

CROSS REFERENCE TO RELATED APPLICATIONS

This application is a national phase of PCT application No. PCT/JP2019/047872, filed on 6 Dec. 2019, which claims priority from Japanese patent application No. 2018-244569, filed on 27 Dec. 2018, all of which are incorporated herein by reference.

TECHNICAL FIELD

The present disclosure relates to a connector.

BACKGROUND

Patent Document 1 discloses a connector in which a contact is inserted into a housing from behind and a retainer is mounted on a rear end part of the housing from behind. The retainer has a function of retaining the contact. A projection-like locking portion is formed on an outer surface of the housing, and the retainer is formed with a resiliently deformable detachable locking portion. In the process of mounting the retainer on the housing, the detachable locking portion rides over the locking portion while being resiliently deformed. When the retainer is properly mounted, the detachable locking portion is locked to the locking portion, whereby the retainer is held with a rearward movement restricted.

PRIOR ART DOCUMENT

Patent Document

Patent Document 1: JP H11-067318 A

SUMMARY OF THE INVENTION

Problems to be Solved

In the process of mounting the retainer on the housing, the detachable locking portion slides in contact with the locking portion while being resiliently deformed. Thus, frictional resistance is produced between the detachable locking portion and the locking portion. This frictional resistance causes a reduction in workability in mounting the retainer. As a countermeasure against this, it is thought to reduce a projection dimension of the locking portion. However, if the projection dimension of the locking portion is reduced, a locking force of the detachable locking portion and the locking portion is reduced. Thus, a problem of reducing a function of holding the retainer in a mounted state occurs.

The present invention was completed on the basis of the above situation and aims to improve a holding force for holding a retainer on a housing.

Means to Solve the Problem

The present disclosure is directed to a connector with a housing, a terminal fitting to be inserted into the housing from behind, and a retainer mounted on the housing, wherein the retainer is movable in a direction intersecting an inserting direction of the terminal fitting between a partial locking position where insertion of the terminal fitting into the housing is allowed and a full locking position where the terminal fitting inserted into the housing is retained, the housing is formed with a displacement restricting portion, and the retainer is formed with a hooking portion capable of coming into contact with the displacement restricting portion from front when the retainer is at the full locking position.

Effect of the Invention

According to the present disclosure, it is possible to improve a holding force for holding a retainer on a housing.

DETAILED DESCRIPTION TO EXECUTE THE INVENTION

Description of Embodiments of Present Disclosure

Figure 1:
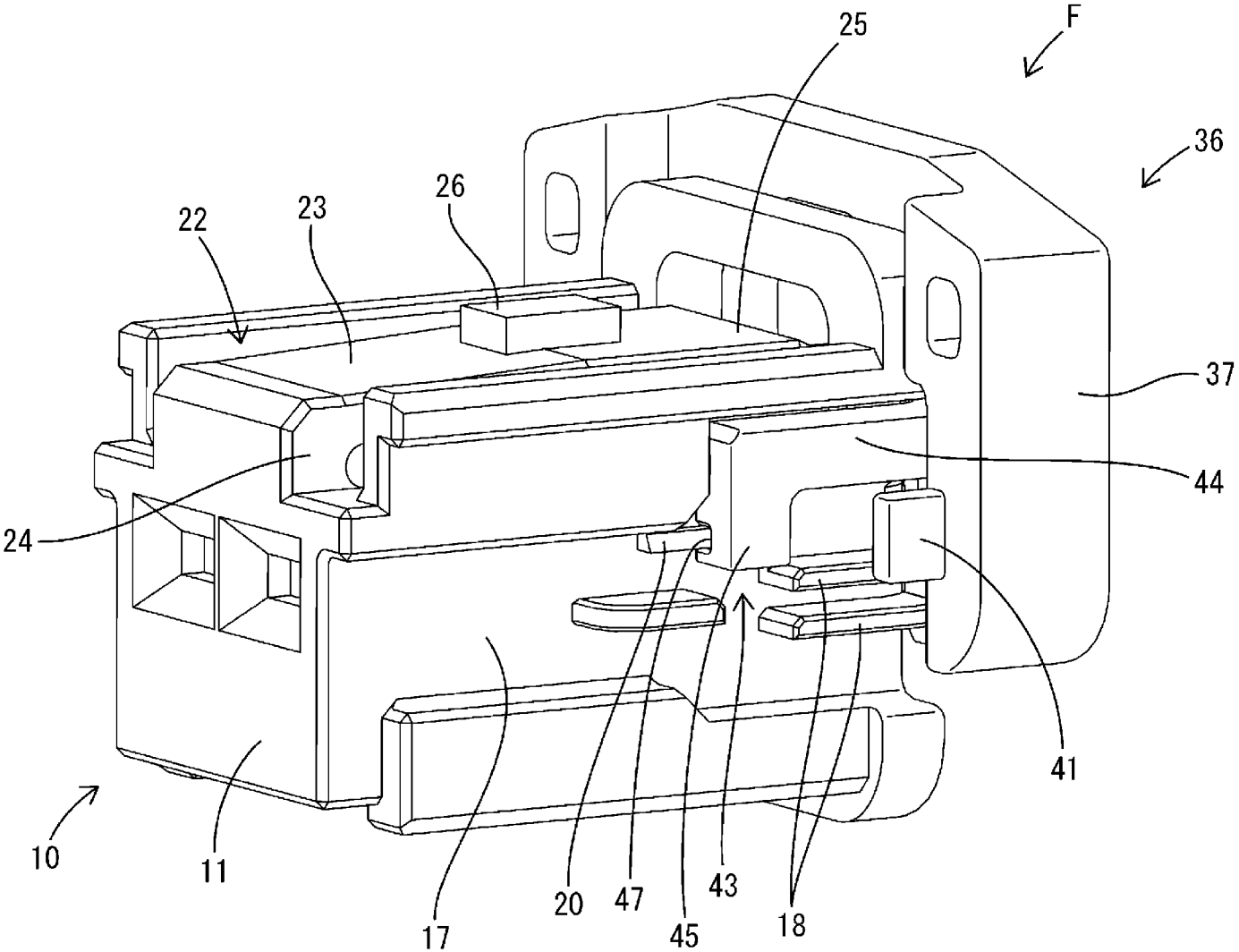
FIG. 1 is a perspective view showing a state where a retainer is held at a partial locking position in a female connector of one embodiment.

First, embodiments of the present disclosure are listed and described.

(1) The connector of the present disclosure includes a housing, a terminal fitting to be inserted into the housing from behind, and a retainer mounted on the housing, wherein the retainer is movable in a direction intersecting an inserting direction of the terminal fitting between a partial locking position where insertion of the terminal fitting into the housing is allowed and a full locking position where the terminal fitting inserted into the housing is retained, the housing is formed with a displacement restricting portion, and the retainer is formed with a hooking portion capable of coming into contact with the displacement restricting portion from front when the retainer is at the full locking position.

According to the configuration of the present disclosure, if the retainer moves from the partial locking position to the full locking position, the hooking portion can come into contact with the displacement restricting portion from front and the retainer is held with a rearward relative displacement with respect to the housing restricted. Since the hooking portion does not ride over the displacement restricting portion when the retainer moves from the partial locking position to the full locking position, a large contact margin of the hooking portion and the displacement restricting portion can be ensured. In this way, a holding force for holding the retainer on the housing can be improved.

(2) Preferably, the hooking portion restricts a movement of the retainer by being fit to a holding portion of the housing when the retainer is at at least one of the partial locking position and the full locking position. According to this configuration, since the hooking portion has an additional function of holding the retainer at the partial locking position and/or the full locking position, the shape of the retainer can be simplified.

(3) Preferably, the connector includes a terminal accommodation chamber formed in the housing, the terminal accommodation chamber accommodating the terminal fitting, a cut portion formed in the housing by recessing a part of an inner wall portion of the terminal accommodation chamber, and a retaining portion formed on the retainer, wherein the retaining portion is accommodated into the cut portion when the retainer is at the partial locking position, and the retaining portion is facing the terminal fitting to be able to come into contact with the terminal fitting from behind when the retainer is at the full locking position. According to this configuration, a contact position of the retaining portion of the retainer and the terminal fitting can be set in a region in front of a rear end in the terminal accommodation chamber. Thus, the interference of external matters with a contact part of the retaining portion and the terminal fitting can be prevented.

(4) Preferably, the terminal fitting is formed with a secondary locking portion projecting into the cut portion, and the secondary locking portion is capable of facing the retaining portion to be able to come into contact with the retaining portion from front when the retainer is at the full locking position. According to this configuration, a projection dimension of the secondary locking portion can be increased in a moving direction of the retainer between the partial locking position and the full locking position to ensure a large contact margin of the secondary locking portion and the retaining portion.

(5) Preferably, the connector includes a lock arm disposed along an outer surface of the housing, wherein the lock arm is resiliently displaced toward the outer surface of the housing in the process of connection to a mating connector, the cut portion is open to face the lock arm in the outer surface of the housing, and the retaining portion is disposed at a position for restricting a resilient displacement of the lock arm when the retainer is at the partial locking position. According to this configuration, if an attempt is made to connect the connector to the mating connector with the retainer left at the partial locking position, the resilient displacement of the lock arm is restricted. In this way, it can be detected that the retainer has not moved to the full locking position yet.

(6) Preferably, the retainer is provided with a detector, the detector interferes with the mating connector in the process of connecting the housing to the mating connector with the retainer located at the partial locking position, and the detector does not interfere with the mating connector with the retainer located at the full locking position. According to this configuration, at which of the partial locking position and the full locking position the retainer is located can be detected in connecting the housing to the mating connector.

DETAILS OF EMBODIMENT OF PRESENT DISCLOSURE

Embodiment

One specific embodiment of a connector of the present disclosure is described with reference to FIGS. 1 to 14. Note that the present invention is not limited to these illustrations and is intended to be represented by claims and include all changes in the scope of claims and in the meaning and scope of equivalents. In the first embodiment, a left side in FIGS. 1, 3 to 5, 7 to 9 and 12 is defined as a front side concerning a front-rear direction. Upper and lower sides shown in FIGS. 1, 2, 4 and 5 to 12 are directly defined as upper and lower sides concerning a vertical direction.

A female connector F of this embodiment includes a female housing 10 made of synthetic resin, a pair of female terminal fittings 27 and a retainer 36 made of synthetic resin.

Figure 4:
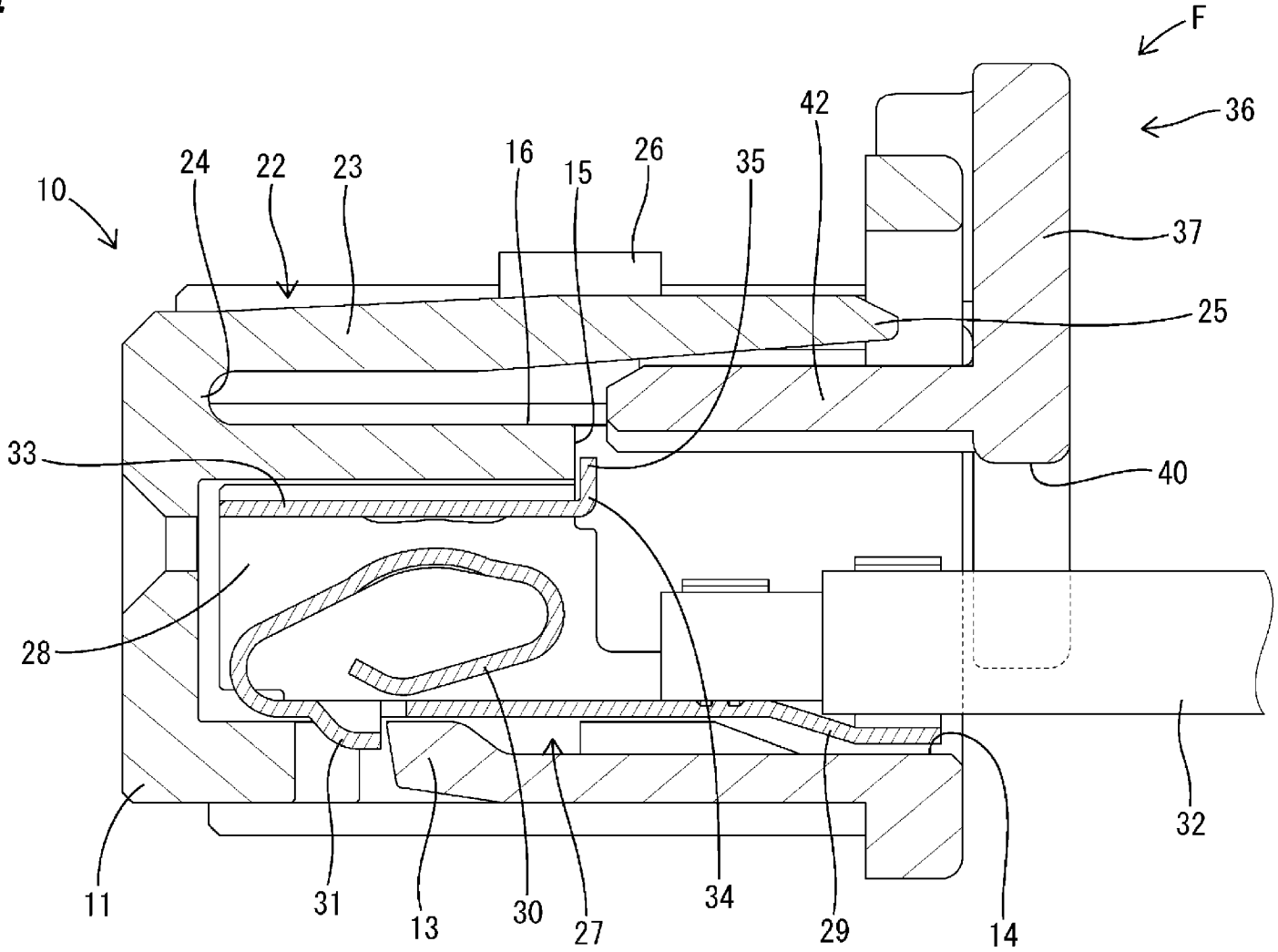
FIG. 4 is a side view in section showing the state where the retainer is held at the partial locking position.
Figure 5:
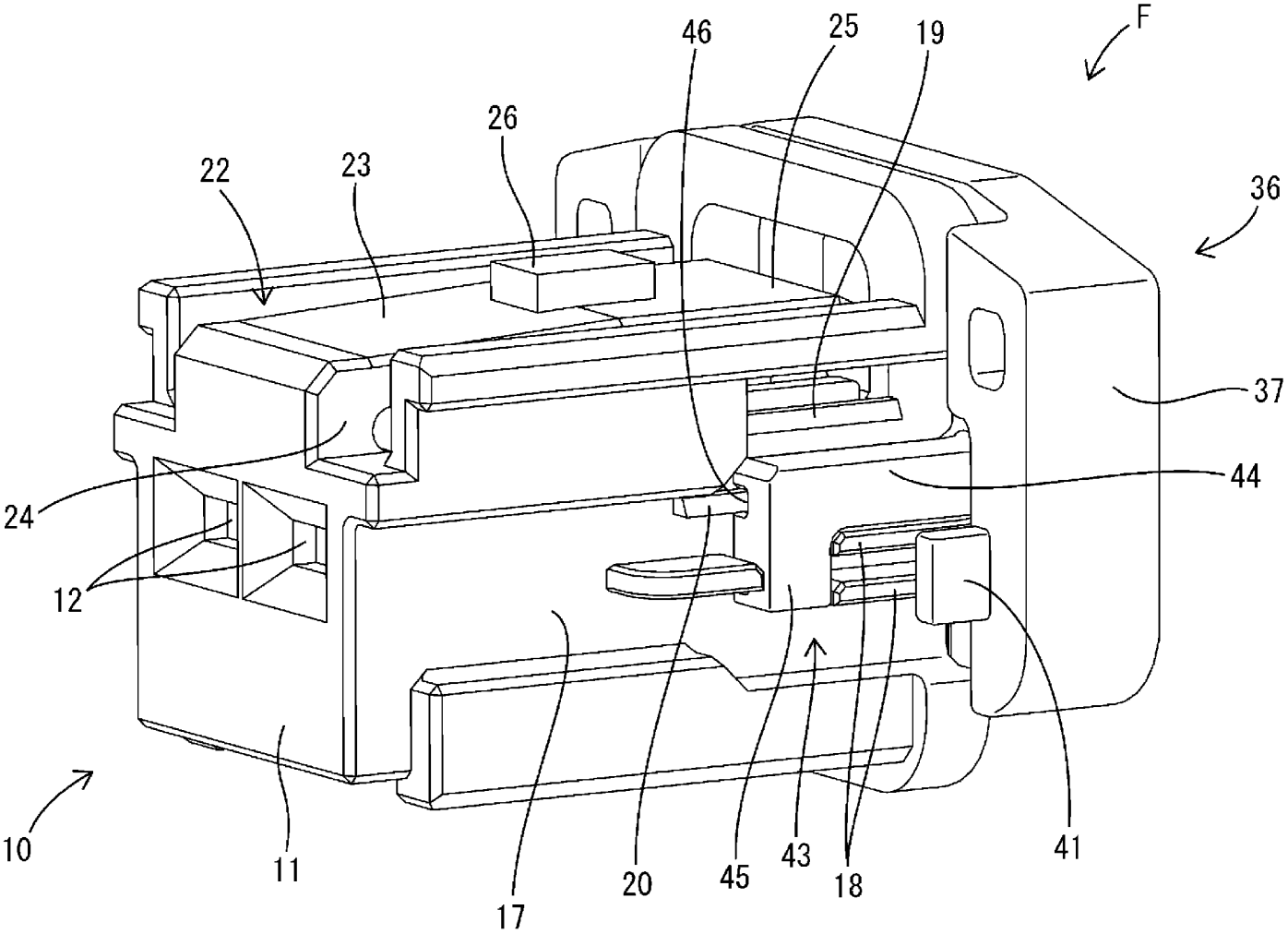
FIG. 5 is a perspective view showing a state where the retainer is held at a full locking position.
Figure 7:
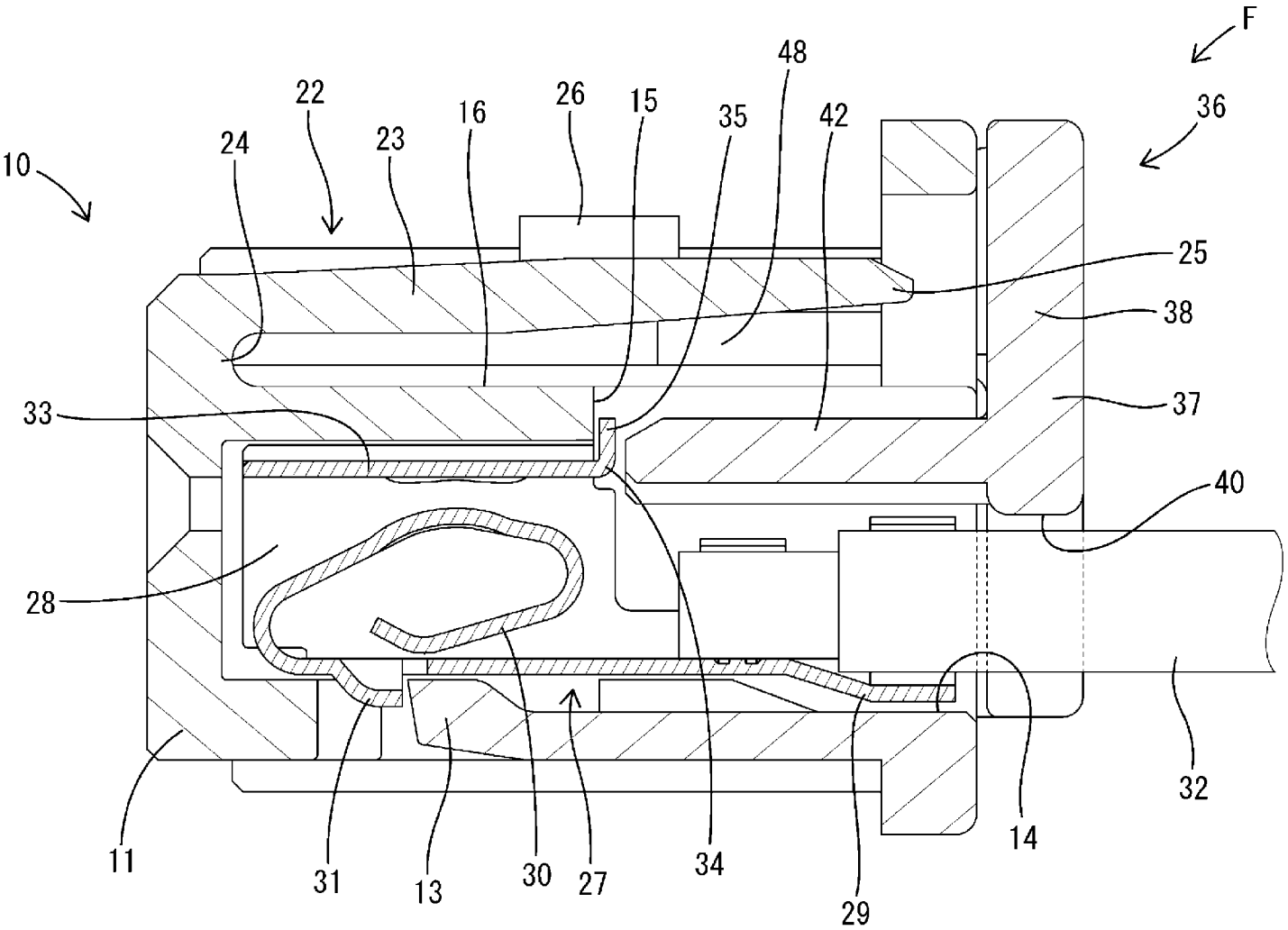
FIG. 7 is a side view in section showing the state where the retainer is held at the full locking position.
Figure 8:
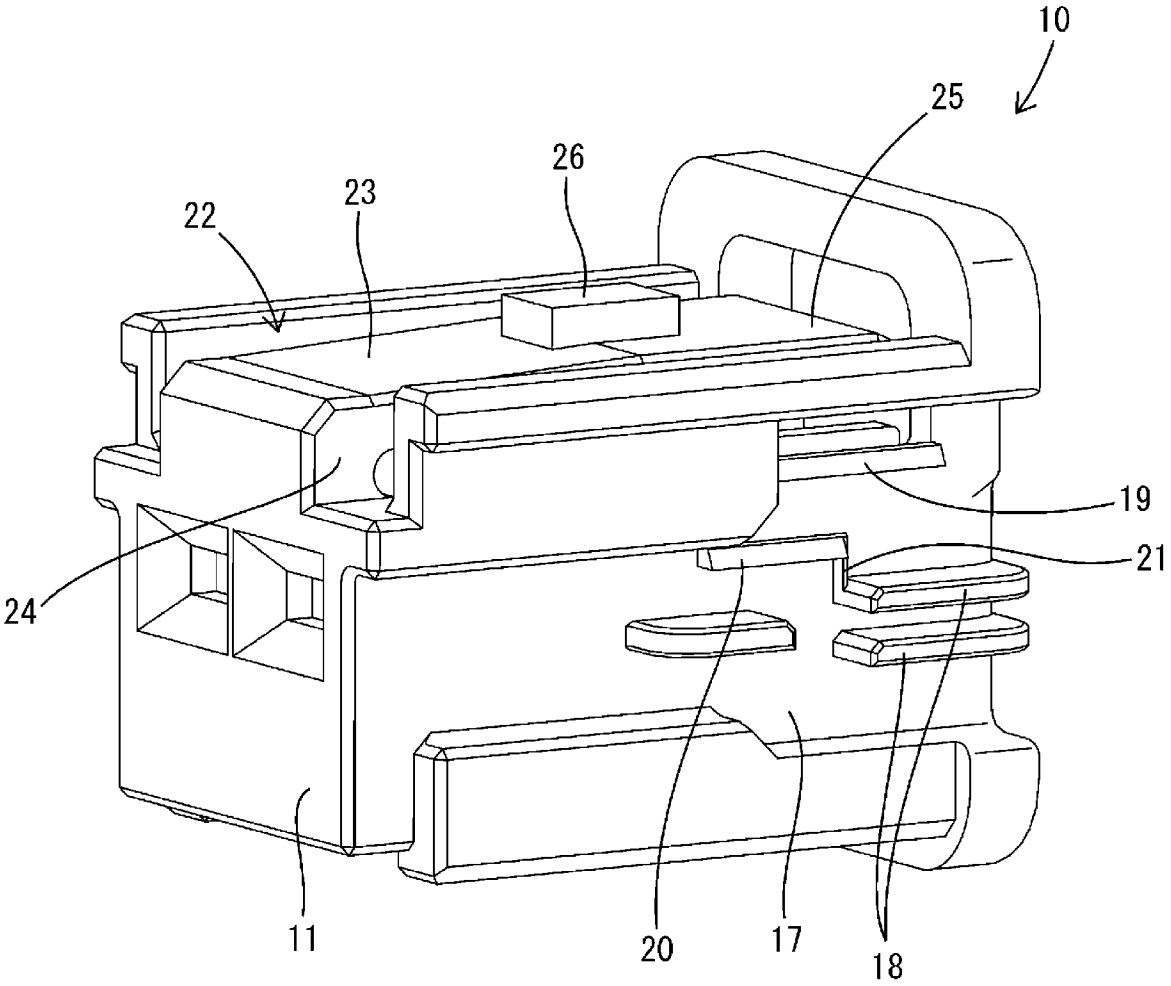
FIG. 8 is a perspective view of the female housing.

As shown in FIGS. 4 and 7, the female housing 10 is a single member integrally formed with a block-shaped terminal accommodating portion 11 and a lock arm 22. A pair of bilaterally symmetrical terminal accommodation chambers 12 are formed laterally side by side in the terminal accommodating portion 11. A locking lance 13 resiliently deformable in the vertical direction is formed at the lower surface of the terminal accommodation chamber 12. The rear end of the terminal accommodation chamber 12 is open as a terminal insertion opening 14 in the rear end surface of the female housing 10.

The terminal accommodating portion 11 is formed with a pair of bilaterally symmetrical cut portions 15. The pair of cut portions 15 are formed by individually recessing rear end side regions of upper wall portions constituting inner wall portions of the pair of left and right terminal accommodation chambers 12. The pair of cut portions 15 are open in outer surfaces 16 (upper surfaces) of the terminal accommodation chambers 12 and the rear end surfaces of the terminal accommodation chambers 12.

As shown in FIGS. 1, 2, 5, 6 and 8, a pair of bilaterally symmetrical recesses 17 open in the rear end surface of the female housing 10 are formed in both left and right side surfaces of the female housing 10 (terminal accommodating portion 11). A pair of upper and lower displacement restricting portions 18, a partial lock holding portion 19, a common holding portion 20 and a partial locking restricting portion 21 are formed as holding portions for holding the retainer 36 at a partial locking position and a full locking position in each of the left and right recesses 17.

The pair of upper and lower displacement restricting portions 18 are in the form of ribs projecting in a width direction (direction orthogonal to an assembling direction of the retainer 36 with the female housing 10) from a rear end part of a side surface of the recess 17. The pair of upper and lower displacement restricting portions 18 are elongated in the front-rear direction (direction parallel to the assembling direction of the retainer 36 with the female housing 10). The pair of upper and lower displacement restricting portions 18 are parallel to each other and arranged at a distance in the vertical direction (direction parallel to a moving direction of the retainer 36 between the partial locking position and the full locking position to be described later). The front ends of the pair of displacement restricting portions 18 are arranged to be aligned at the same position in the front-rear direction.

The partial lock holding portion 19 is in the form of a rib projecting in the width direction from the side surface of the recess 17, similarly to the displacement restricting portions 18. A projection dimension of the partial lock holding portion 19 is smaller than those of the displacement restricting portions 18. The partial lock holding portion 19 is elongated in the front-rear direction and arranged above the pair of displacement restricting portions 18. A formation region of the partial lock holding portion 19 in the front-rear direction is a range from a position forward of the front ends of the displacement restricting portions 18 to a position rearward of the front ends of the displacement restricting portions 18.

The common holding portion 20 is in the form of a rib projecting in the width direction from the side surface of the recess 17, similarly to the displacement restricting portions 18 and the partial lock holding portion 19. A projection dimension of the common holding portion 20 is substantially equal to that of the partial lock holding portion 19. The common holding portion 20 is elongated in the front-rear direction. The common holding portion 20 is arranged at a position above the pair of displacement restricting portions 18 and below the partial lock holding portion 19. A formation region of the common holding portion 20 in the front-rear direction is a range from a position forward of the front ends of the displacement restricting portions 18 to substantially the same position as the front ends of the displacement restricting portions 18.

The partial lock restricting portion 21 is in the form of a rib projecting in the width direction from the side surface of the recess 17, similarly to the displacement restricting portions 18, the partial lock holding portion 19 and the common holding portion 20. A projection dimension of the partial lock restricting portion 21 is set to be smaller than those of the partial lock holding portion 19 and the common holding portion 20. The partial lock restricting portion 21 is elongated in the front-rear direction. The upper end of the partial lock restricting portion 21 is connected to a rear end part of the common holding portion 20. The lower end of the partial lock restricting portion 21 is connected to a front end part of the upper displacement restricting portion 18.

As shown in FIGS. 4 and 7, the lock arm 22 includes an arm body portion 23 and a supporting portion 24. The arm body portion 23 is elongated in the front-rear direction along the outer surface 16 (upper surface) of the terminal accommodating portion 11. The supporting portion 24 extends downward from a front end part of the arm body portion 23 and is connected to the outer surface 16 (upper surface) of the terminal accommodating portion 11. The lock arm 22 is resiliently deformable in the vertical direction with the supporting portion 24 serving as a fulcrum.

When the lock arm 22 is in a free state without being resiliently deformed, the arm body portion 23 is facing the upper surface of the terminal accommodating portion 11 while being vertically spaced apart therefrom. A rear end part of the arm body portion 23 functions as an operating portion 25 for unlocking. A lock projection 26 is formed on the upper surface of the arm body portion 23. A rear end side region of the arm body portion 23 in the front-rear direction is arranged to face openings of the pair of cut portions 15 in the upper surface of the terminal accommodating portion 11.

As shown in FIGS. 4 and 7, the female terminal fitting 27 includes a rectangular tube portion 28 in a front end part and a crimping portion 29 in the form of an open barrel in a rear end part. A resilient contact piece 30 is accommodated in the rectangular tube portion 28. A projection-like primary locking portion 31 is formed on the lower surface of the rectangular tube portion 28. A lower plate portion constituting the rectangular tube portion 28 is connected to a base plate portion of the crimping portion 29. The crimping portion 29 is conductively crimped to a front end part of a coated wire 32.

An upper plate portion 33 constituting the rectangular tube portion 28 is located above the crimping portion 29. Due to a height difference between the upper plate portion 33 and the crimping portion 29, a rear end part of the upper plate portion 33 of the rectangular tube portion 28 functions as a step-shaped secondary locking portion 34. The secondary locking portion 34 includes a contact portion 35 extending upward substantially perpendicularly from the rear end of the upper plate portion 33 and cantilevered.

The female terminal fitting 27 is inserted into the terminal accommodation chamber 12 from behind the female housing 10. The properly inserted female terminal fitting 27 is held in a retained state by locking the primary locking portion 31 to the locking lance 13. The coated wire 28 fixed to the female terminal fitting 27 is drawn out rearward from the female housing 10. With the female terminal fitting 27 inserted at a proper position, the rectangular tube portion 28 is accommodated in a region in front of the cut portion 15 (back region of the terminal accommodating portion 12), out of the terminal accommodating portion 11. The upper plate portion 33 is located to closely face the upper wall portion of the terminal accommodation chamber 12. The contact portion 35 of the secondary locking portion 34 is accommodated in the cut portion 15 and disposed along the front surface of the cut portion 15. The crimping portion 29 is accommodated in a rear end side region where the cut portion 15 is formed, out of the terminal accommodation chamber 12, in the front-rear direction.

Figure 9:
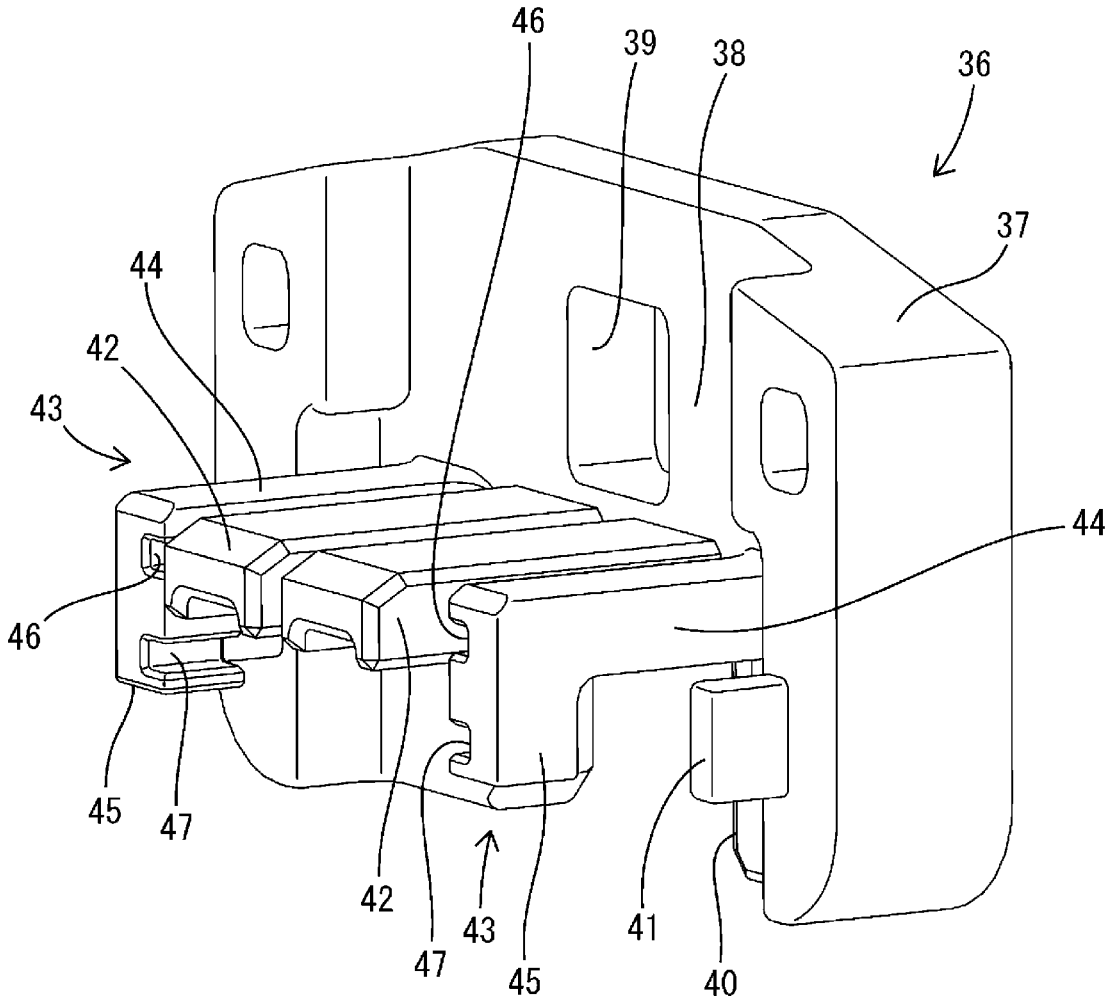
FIG. 9 is a perspective view of the retainer.
Figure 10:
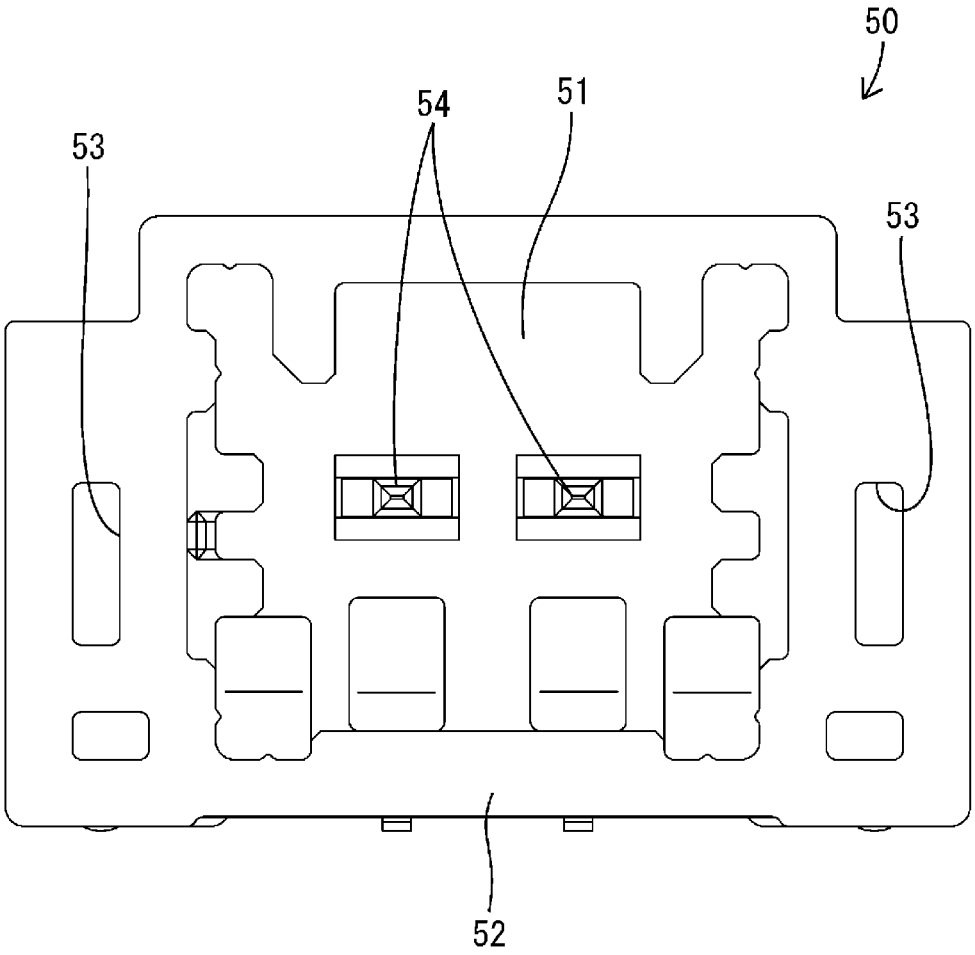
FIG. 10 is a front view of a male housing.
Figure 11:
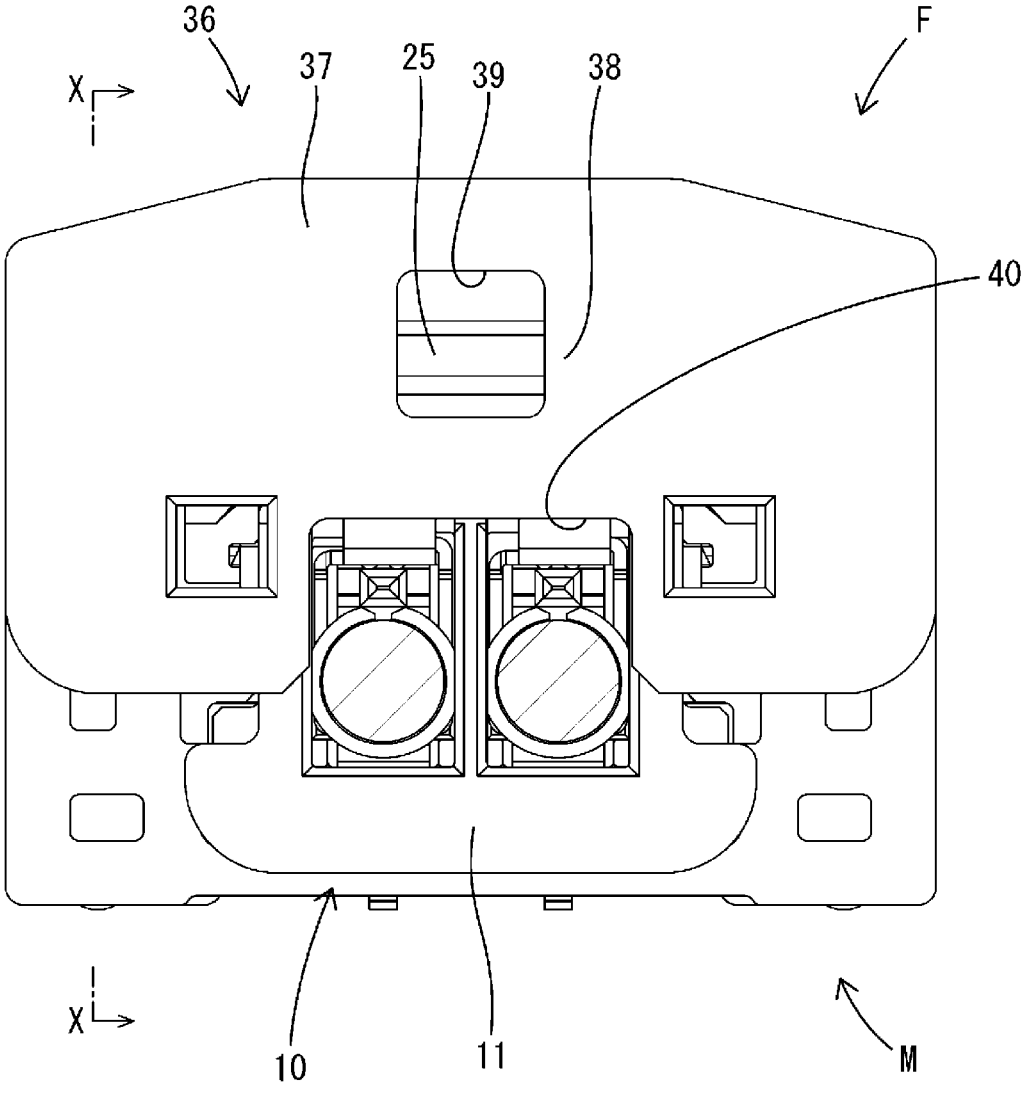
FIG. 11 is a back view showing a state where the connection of the female connector to a male connector is started with the retainer held at the partial locking position.
Figure 12:
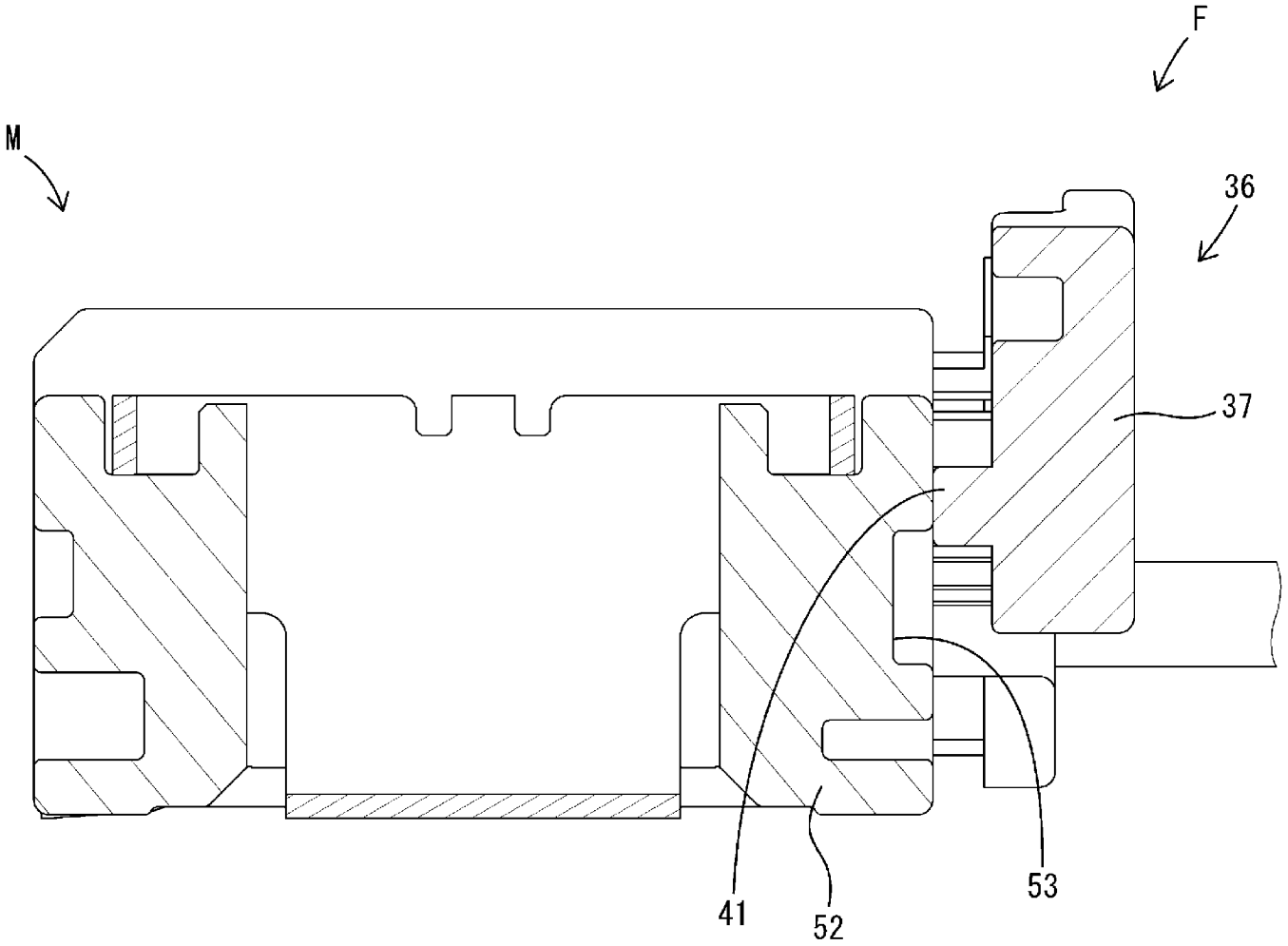
FIG. 12 is a section along X-X of FIG. 11.
Figure 13:
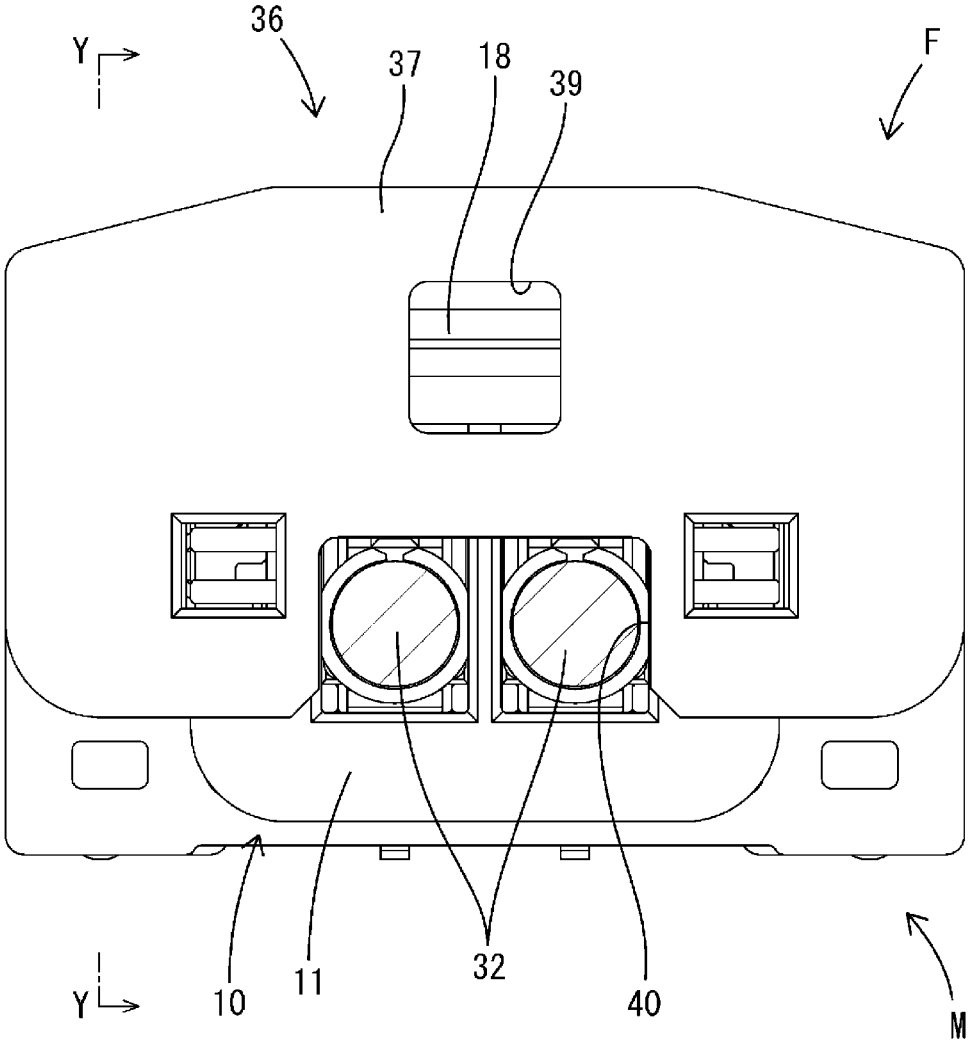
FIG. 13 is a back view showing a state where the female connector is connected to a male connector with the retainer held at the full locking position.

As shown in FIG. 9, the retainer 36 is a single component including a rear wall portion 37, a pair of bilaterally symmetrical detection protrusions 41, a pair of bilaterally symmetrical retaining portions 42 and a pair of bilaterally symmetrical hooking portions 43. The rear wall portion 37 is substantially in the form of a flat plate having a wall thickness direction aligned with the front-rear direction. The rear wall portion 37 has a substantially rectangular back view shape and is dimensioned to cover the entire rear surface of the female housing 10. Out of the rear wall portion 37, regions corresponding to both left and right end parts of the operating portion 25 in a back view function as a covering portion 38.

An operation hole 39 penetrating in the front-rear direction (thickness direction of the rear wall portion 37) is formed in a region corresponding to a laterally central part of the operating portion 25 in the back view, out of the rear wall portion 37. The rear wall portion 37 is formed with an escaping portion 40 by cutting a region corresponding to the terminal accommodation chambers 12 in the back view. The escaping portion 40 is a part open in the lower end edge of the rear wall portion 37 to avoid the interference of the coated wires 32 and the retainer 36. The pair of detection protrusions 41 are arranged on both left and right end parts of the front surface of the rear wall portion 37. The detection protrusions 41 are cantilevered from the front surface of the rear wall portion 37.

The pair of left and right retaining portions 42 are cantilevered forward from the front surface (surface facing the rear surface of the female housing 10) of the rear wall portion 37. A projecting direction of the retaining portions 42 is parallel to an inserting direction of the female terminal fittings 27 into the female housing 10 and an assembling direction of the retainer 36 with the female housing 10. The projecting direction of the retaining portions 42 is a direction orthogonal to the moving direction of the retainer 36 between the partial locking position and the full locking position. In a lateral direction, the pair of retaining portions 42 are disposed at positions closer to a center than to both left and right ends of the rear wall portion 37.

The pair of hooking portions 43 are arranged at positions sandwiching the pair of retaining portions 42 from left and right sides on the front surface of the rear wall portion 37. Each hooking portion 43 is cantilevered from the front surface of the rear wall portion 37 as a whole. In particular, the hooking portion 43 includes a base portion 44 projecting forward from the rear wall portion 37 and a projection 45 projecting downward from the lower surface of a projecting end part (front end part) of the base portion 44. A projecting direction of the projection 45 is the same direction as the moving direction of the retainer 36 from the partial locking position to the full locking position. A side view shape of the hooking portion 43 is a substantially L shape. The hooking portion 43 is resiliently displaceable in the lateral direction with a rear end part (part connected to the rear wall portion 37) thereof serving as a fulcrum.

A common fitting groove 46 is formed in an inner side surface facing the projection 45 on a mating side, out of both left and right side surfaces of the base portion 44. The common fitting groove 46 extends in the front-rear direction (direction parallel to the assembling direction of the retainer 36 with the female housing 10). The common fitting groove 46 is open in the front end surface of the base portion 44 (hooking portion 43). A partial lock fitting groove 47 is formed in an inner side surface facing the projection 45 on the mating side, out of both left and right side surfaces of the projection 45. The partial lock fitting groove 47 extends in a direction parallel to the common fitting groove 46, i.e. in the front-rear direction. The partial lock fitting groove 47 is arranged below the common fitting groove 46. The partial lock fitting groove 47 is open in the front and rear end surfaces of the projection 45.

The retainer 36 is assembled with a rear end part of the terminal accommodating portion 11 from behind the female housing 10. In assembling the retainer 36, the pair of hooking portions 43 are caused to extend along both left and right outer side surfaces of the terminal accommodating portion 11 and the common fitting grooves 46 are fit to slide in contact with the partial lock holding portions 19. By the fitting of the common fitting grooves 46 and the partial lock holding portions 19, the retainer 36 is vertically positioned with respect to the female housing 10 and guided with posture inclination in the vertical direction restricted.

In the process of assembling the retainer 36, the pair of hooking portions 43 are resiliently deformed away from each other in the lateral direction as the inner side surfaces of the projections 45 ride over the partial lock restricting portions 21. An assembling process of the retainer 36 is completed when the retainer 36 reaches the partial locking position (see FIGS. 1, 2, 4 and 11). If the retainer 36 reaches the partial locking position, the rear wall portion 37 comes into contact with the rear end surface of the terminal accommodating portion 11, the projections 45 pass over the partial lock restricting portions 21 and the pair of hooking portions 43 resiliently return inward in the lateral direction.

Figure 2:
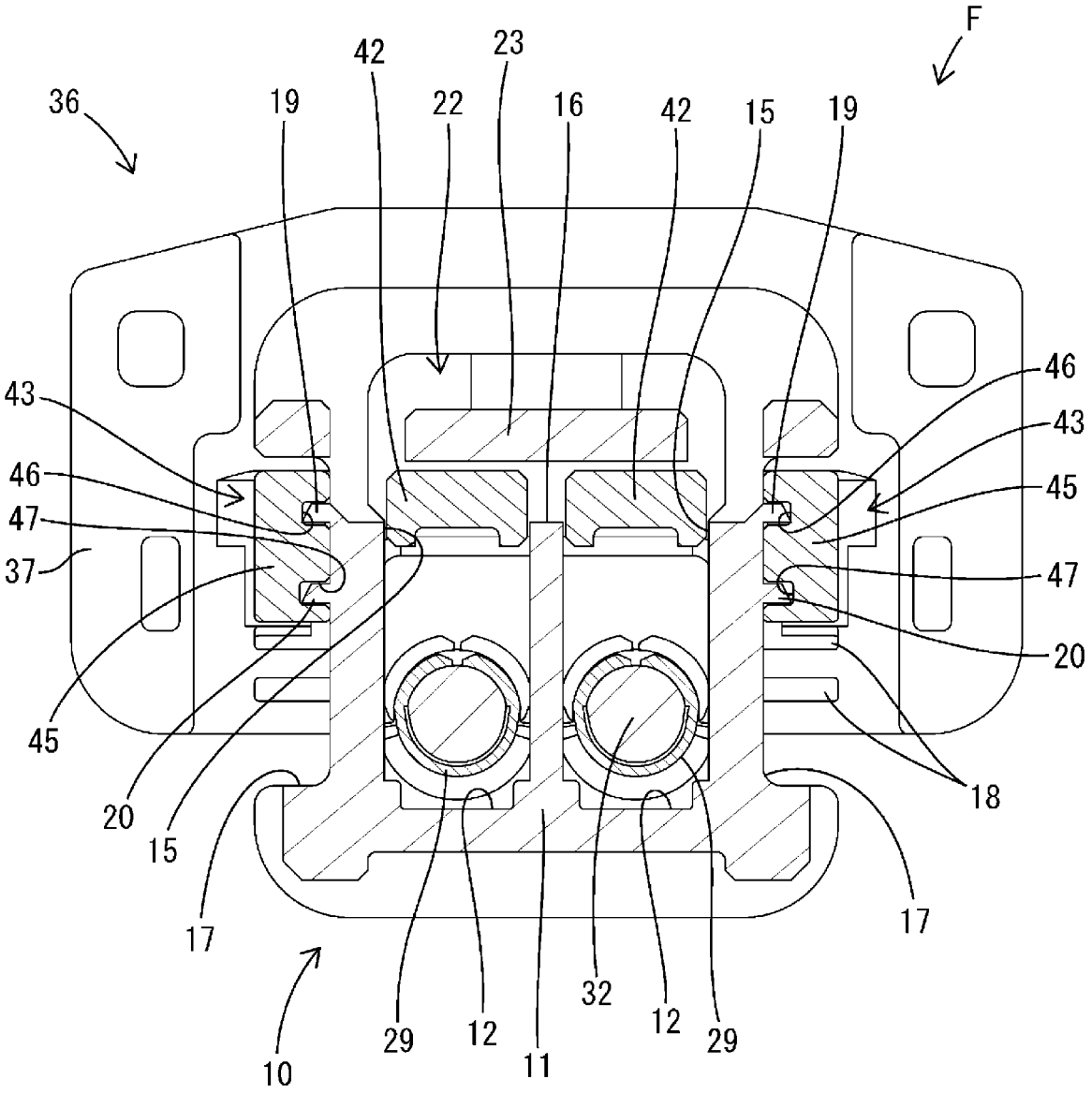
FIG. 2 is a front view in section showing the state where the retainer is held at the partial locking position.
Figure 3:
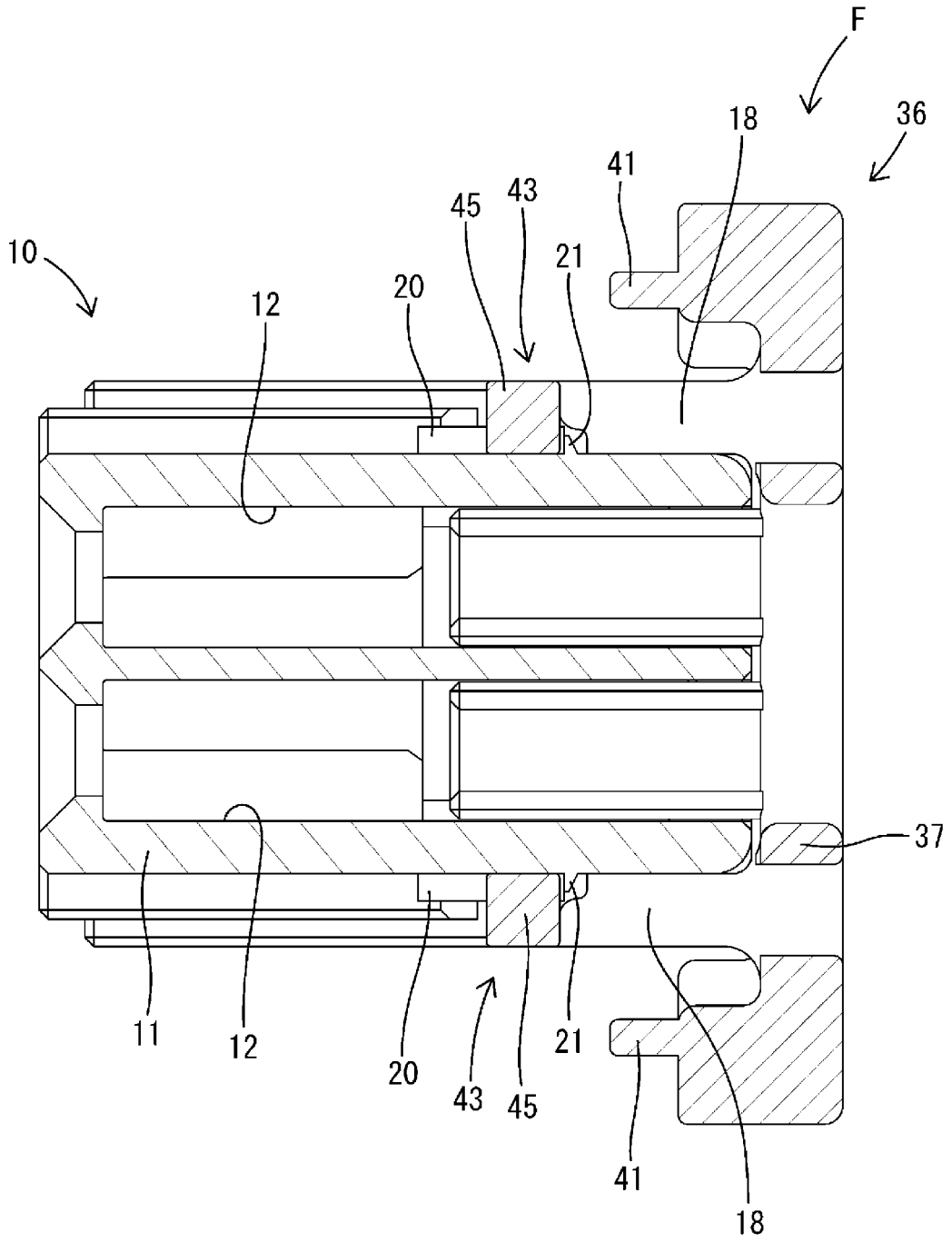
FIG. 3 is a plan view in section showing a state where the retainer is assembled with a female housing.

If the hooking portions 43 resiliently return, the rear surfaces of the projections 45 are facing the partial lock restricting portions 21 to be able to contact the partial lock restricting portions 21 from front as shown in FIG. 3. Thus, rearward separation of the retainer 36 from the female housing 10 is restricted. Further, by the resilient return of the hooking portions 43, the partial lock fitting grooves 47 are fit to the common holding portions 20. The common fitting grooves 46 are kept fit to the partial lock holding portions 19. As shown in FIG. 2, the retainer 36 is in a semi-locked state with a vertical movement restricted and held at the partial locking position by the fitting of the partial lock fitting grooves 47 and the common holding portions 20 and the fitting of the common fitting grooves 46 and the partial lock holding portions 19.

With the retainer 36 located at the partial locking position, lower parts of the pair of retaining portions 42 are individually accommodated in the pair of cut portions 15 and upper parts of the pair of retaining portions 42 are accommodated in a space between the upper surface (outer surface 16) of the terminal accommodating portion 11 and the lower surface of the lock arm 22 as shown in FIGS. 2 and 4. The upper surfaces of the retaining portions 42 are located to closely face the lower surface of the arm body portion 23. Since the retaining portions 42 are retracted upward from insertion/withdrawal paths of the female terminal fittings 27 into and from the terminal accommodation chambers 12, the female terminal fittings 24 can be inserted into and withdrawn from the terminal accommodation chambers 12. Thus, an operation of mounting the female terminal fittings 27 into the female housing 10 can be performed with the retainer 36 held at the partial locking position.

If a downward operation force is applied to the retainer 36 at the partial locking position, the retainer 36 parallelly moves downward. During this time, the front surface of the rear wall portion 37 slides in contact with the rear end surfaces of the terminal accommodation chambers 12, whereby the retainer 36 is guided. If a movement of the retainer 36 starts, the pair of hooking portions 43 are resiliently deformed away from each other, the common fitting grooves 46 are disengaged from the partial lock holding portions 19 and the partial lock fitting grooves 47 are disengaged from the common holding portions 20. Then, front end parts of the hooking portions 43 ride on the partial lock holding portions 19 and the common holding portions 20 and slide in contact with projecting end parts of the both holding portions 19, 20.

Projection dimensions of the displacement restricting portions 18 are larger than those of the both holding portions 19, 20. While the front end parts of the hooking portions 43 slide in contact with the projecting end parts of the both holding portions 19, 20, the rear surfaces of the projections 45 are kept in such a positional relationship as to slidably face the front end surfaces of the both upper and lower displacement restricting portions 18 from front. In this way, a rearward relative movement of the retainer 36 with respect to the female housing 10 is restricted.

Figure 6:
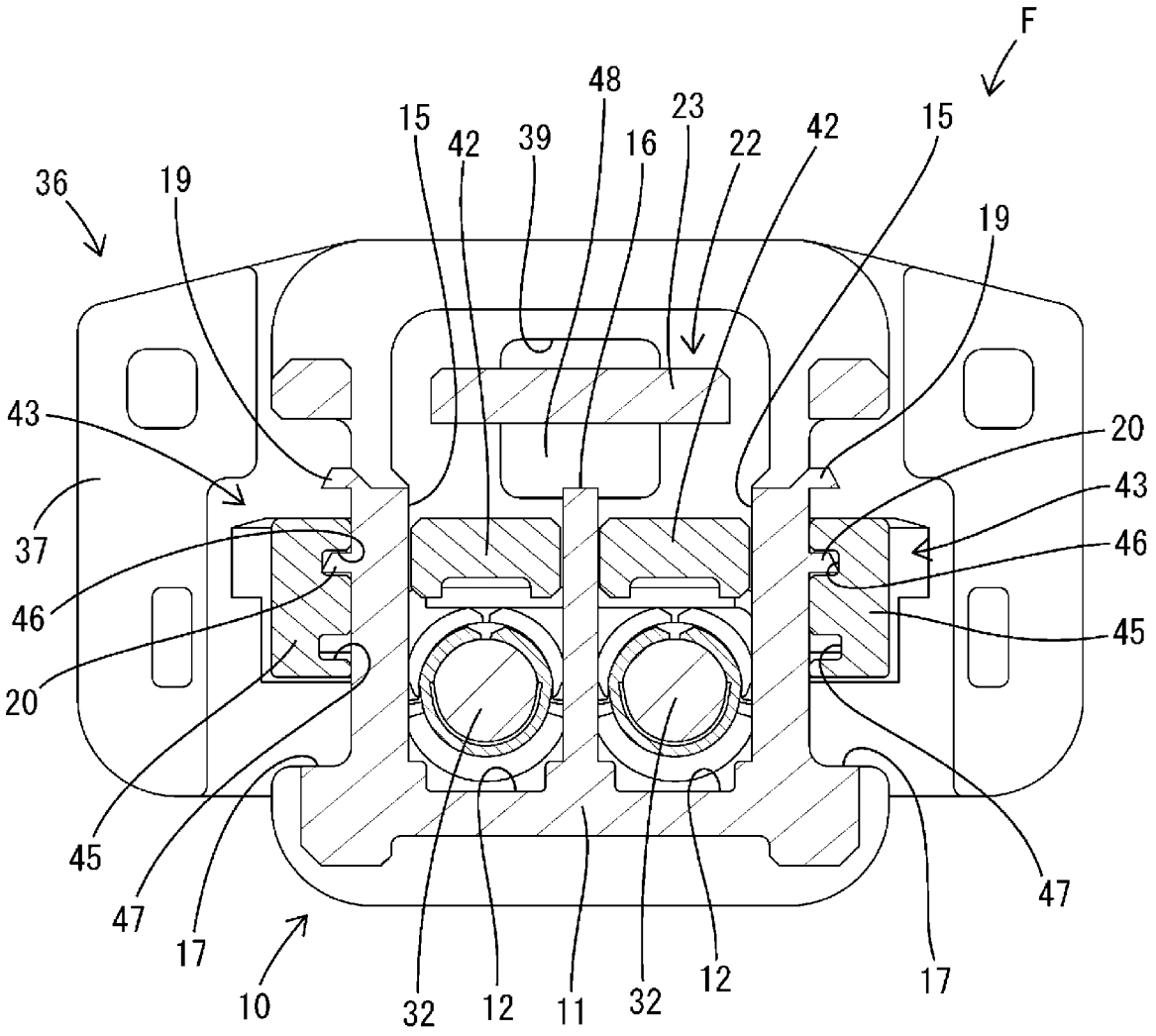
FIG. 6 is a front view in section showing the state where the retainer is held at the full locking position.

If the retainer 36 reaches the full locking position (see FIGS. 5 to 7 and 13), the pair of hooking portions 43 resiliently return toward each other and, as shown in FIG. 6, the common fitting grooves 46 are fit to the common holding portions 20. By this fitting, the retainer 36 is held at the full locking position with a vertical relative movement of the retainer 36 with the female housing 10 restricted.

Further, as shown in FIG. 2, the rear surfaces of the projections 45 are facing to be able to contact the front surfaces of the both upper and lower displacement restricting portions 18 from front. In this way, a rearward relative displacement (separation) of the retainer 36 with respect to the female housing 10 is restricted. Further, with the retainer 36 held at the full locking position, the covering portion 38 covers the operating portion 25 of the lock arm 22 from behind. Thus, even if an external matter approaches the operating portion 25 from behind, there is no possibility that the external matter contacts the operating portion 25.

In the process of moving the retainer 36 from the partial locking position to the full locking position, the projections 45 are constantly located in front of the displacement restricting portions 18. Thus, the projections 45 do not ride over the displacement restricting portions 18 and frictional resistance due to the resilient deformation of the hooking portions 43 is not produced between the projections 45 and the displacement restricting portions 18. Thus, even if the projection dimensions of the displacement restricting portions 18 are set to be large, frictional resistance when the retainer 36 is moved between the partial locking position and the full locking position is not increased.

Further, in the process of moving the retainer 36 from the partial locking position to the full locking position, the retaining portions 42 retracted into the cut portions 15 are lowered to the same height as the contact portions 35 of the secondary locking portions 34. Then, rear end parts of the retaining portions 42 are facing the contact portions 35 to be able to contact the contact portions 35 from behind. Thus, with the retainer 36 located at the full locking position, even if the coated wire 32 is pulled rearward, a rearward relative displacement of the female terminal fitting 27 is restricted since the contact portion 35 (secondary locking portion 34) comes into contact with the retaining portion 42. The female terminal fitting 27 is reliably held in the retained state by a locking action of the primary locking portion 31 with the locking lance 13 and a locking action of the secondary locking portion 34 with the retainer 36.

In withdrawing the female terminal fitting 27 from the female housing 10, the retainer 36 at the full locking position is moved to the partial locking position to release a secondarily locked state by the retainer 36 (retaining portions 42). Subsequently, the locking lance 13 is resiliently deflected using a jig (not shown) to be disengaged from the primary locking portion 31. Then, the coated wire 32 may be pulled rearward with the locking lance 13 kept disengaged from the primary locking portion 31.

The female connector F is connectable to a male connector M. The male connector M functions as a board connector to be mounted on a circuit board (not shown). The male connector M includes a male housing 50 and a pair of male terminal fittings 54 mounted in the male housing 50. The male housing 50 includes a wall-like terminal penetrating portion 51 and a receptacle 52 in the form of a rectangular tube projecting toward a front side (toward the female connector F) from the outer peripheral edge of the terminal penetrating portion 51.

A lock hole (not shown) is formed in an upper surface part constituting the receptacle 52. Recessed detection receiving portions 53 are formed in front surfaces (surfaces facing the female connector F when the both connectors F, M are connected) of both left and right side surface parts constituting the receptacle 52 (see FIGS. 12 and 14). The male terminal fittings 54 are passed through the terminal penetrating portion 51, tabs on the tips of the male terminal fittings 54 are accommodated into the receptacle 52, and board connecting portions of the male terminal fittings 54 are soldered and fixed to the circuit board (not shown).

Figure 14:
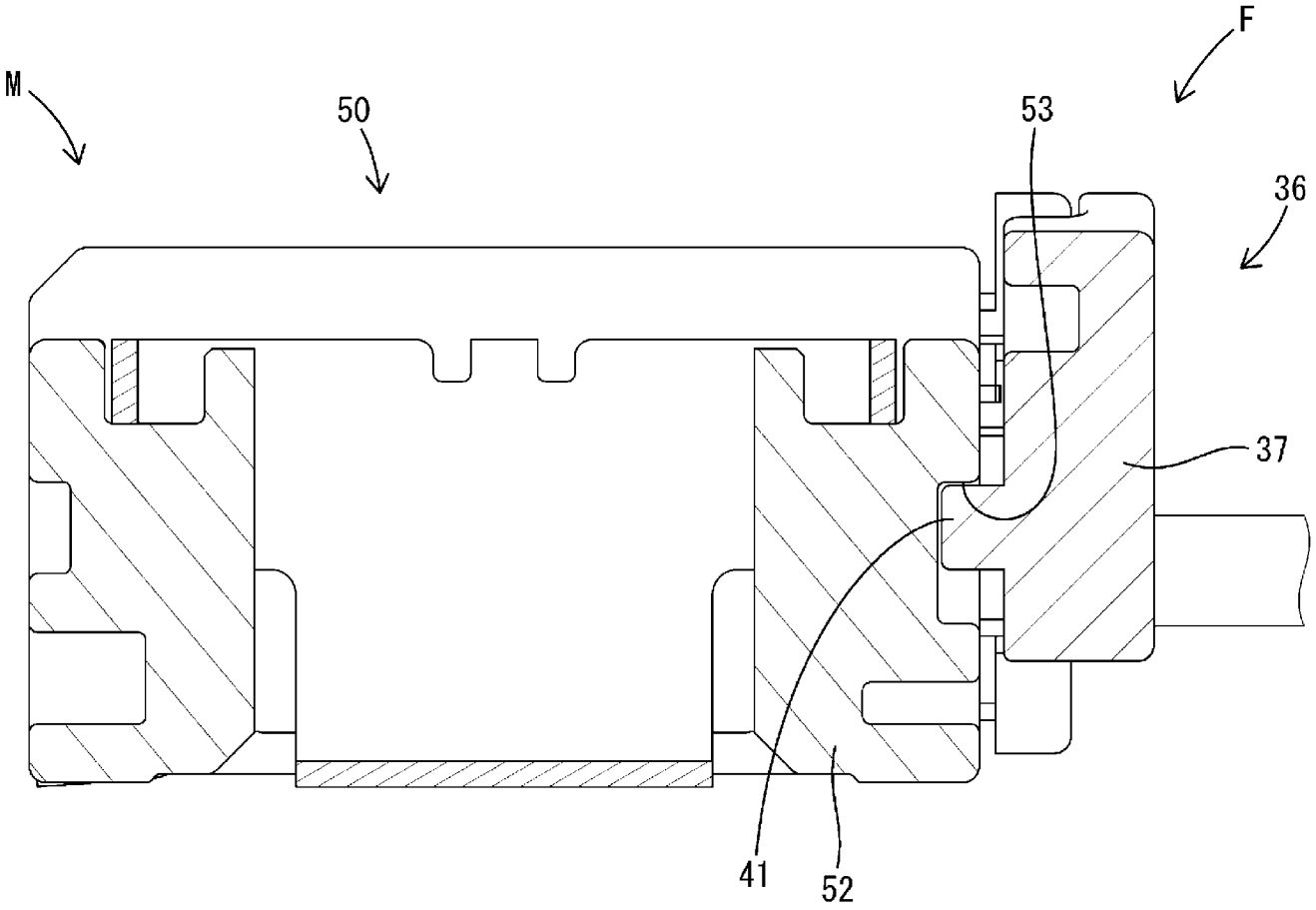
FIG. 14 is a section along X-X of FIG. 13.

In the process of connecting the female connector F to the male connector M, the lock projection 26 interferes with the upper surface part of the receptacle 52, whereby the lock arm 22 is resiliently deflected in a direction toward the upper surface (outer surface 16) of the terminal accommodating portion 11 (downward). At this time, if the retainer 36 is held at the full locking position, a sufficient deflection space 48 is secured between the upper surface (outer surface 16) of the terminal accommodating portion 11 and the lower surface of the arm body portion 23 as shown in FIG. 7. Thus, a resilient deflecting operation of the lock arm 22 is not hindered. Further, with the retainer 36 located at the full locking position, the detection protrusions 41 of the retainer 36 are fit into the detection receiving portions 53 without interfering with the male housing 50 as shown in FIG. 14. Thus, a connecting operation of the both connectors F, M is not hindered.

If the both connectors F, M reach a properly connected state, the lock arm 22 resiliently returns to lock the lock projection 26 into the lock hole and the both connectors F, M are locked in the connected state. Further, since the detection protrusions 41 are fit into the detection receiving portions 53, an upward (direction toward the partial locking position) movement of the retainer 36 with respect to the both connectors F, M is restricted. Thus, the reliability of a secondary locking function by the retainer 36 is excellent.

If the connection of the both connectors F, M is started with the retainer 36 left at the partial locking position, the retaining portions 42 of the retainer 36 enter the deflection space 48 above the upper surface (outer surface 16) of the terminal accommodating portion 11 and closely face the arm body portion 23. Thus, while the both connectors F, M are being connected, the lower surface of the arm body portion 23 interferes with the retaining portions 42 to restrict any further resilient deflection of the lock arm 22 immediately after the lock arm 22 is resiliently deflected. In this way, the connecting operation of the both connectors F, M is also restricted.

Further, if the both connectors F, M are forcibly connected with the retainer 36 located at the partial locking position, the lock arm 22 pushes the retaining portions 42, whereby the retainer 36 moves toward the full locking position. However, when the amount of resilient deflection of the lock arm 22 reaches a maximum, the retainer 36 has not reached the full locking position yet. Thus, the detection protrusions 41 are not fit into the detection receiving portions 53 and interfere with the front surface of the male housing 50 (receptacle 52) while the both connectors F, M are being connected. By this interference, any further connecting operation of the both connectors F, M is restricted. In this way, it is detected that the retainer 36 is not held at the full locking position.

The female connector F of this embodiment includes the female housing 10, the female terminal fittings 27 to be inserted into the female housing 10 from behind, and the retainer 36 to be mounted on the female housing 10. The retainer 36 is movable in the vertical direction intersecting the inserting direction of the female terminal fittings 27 between the partial locking position where the insertion of the female terminal fittings 27 into the female housing 10 is allowed and the full locking position where the female terminal fittings 27 inserted into the female housing 10 are retained.

The female housing 10 is formed with the displacement restricting portions 18, and the retainer 36 is formed with the hooking portions 43 capable of coming into contact with the displacement restricting portions 18 from front when the retainer 36 is at the full locking position. If the retainer 36 moves from the partial locking position to the full locking position, the hooking portions 43 can come into contact with the displacement restricting portions 18 from front and the retainer 36 is held in a state where a rearward relative displacement with respect to the female housing 10 is restricted. Since the hooking portions 43 do not ride over the displacement restricting portions 18 in moving the retainer 36 from the partial locking position to the full locking position, large contact margins of the hooking portions 43 and the displacement restricting portions 18 can be ensured. In this way, a holding force for holding the retainer 36 on the female housing 10 can be improved.

The hooking portions 43 restrict a movement of the retainer 36 by being fit to the partial locking holding portions 19 and the common holding portions 20 when the retainer 36 is at the partial locking position. Further, the hooking portions 43 restrict a movement of the retainer 36 by being fit to the common holding portions 20 of the female housing 10 when the retainer 36 is at the full locking position. According to this configuration, since the hooking portions 43 have an additional function of holding the retainer 36 at the partial locking position and the full locking position, the shape of the retainer 36 can be simplified as compared to the case where fitting parts to the partial locking holding portions 19 and the common holding portions 20 are formed separately from the hooking portions 43.

The female housing 10 is formed with the terminal accommodation chambers 12 for accommodating the female terminal fittings 27 and the cut portions 15 formed by recessing parts of the inner wall portions of the terminal accommodation chambers 12. The retainer 36 is formed with the retaining portions 42. When the retainer 36 is at the partial locking position, the retaining portions 42 are accommodated in the cut portions 15. When the retainer 36 is at the full locking position, the retaining portions 42 are facing the female terminal fittings 27 to be able to contact with the female terminal fittings 27 from behind. According to this configuration, contact positions of the retaining portions 42 of the retainer 36 and the female terminal fittings 27 can be set in regions forward of the rear ends in the terminal accommodation chambers 12 (back sides of the terminal accommodation chambers 12). In this way, the interference of external matters with contact parts of the retaining portions 42 and the female terminal fittings 27 can be prevented.

The female terminal fitting 27 is formed with the secondary locking portion 34 (contact portion 35). The secondary locking portion 34 projects into the cut portion 15 and can face the retaining portion 42 to be able to contact the retaining portion 42 from front when the retainer 36 is at the full locking position. According to this configuration, the projection dimension of the secondary locking portion 34 can be increased to ensure a large contact margin of the secondary locking portion 34 and the retaining portion 42 in the moving direction of the retainer 36 between the partial locking position and the full locking position.

The female housing 10 includes the lock arm 22 disposed along the outer surface 16 of the female housing 10 (upper surface of the terminal accommodating portion 11). The lock arm 22 is resiliently displaced toward the outer surface 16 of the female housing 10 in the process of connection to the male connector M. The cut portions 15 are open to face the lock arm 22 in the outer surface 16 of the female housing 10.

When the retainer 36 is at the partial locking position, the retaining portions 42 are disposed at positions for restricting a resilient displacement of the lock arm 22 (in the deflection space 48). According to this configuration, if an attempt is made to connect the female connector F to the male connector M with the retainer 36 left at the partial locking position, the resilient displacement of the lock arm 22 is restricted. In this way, it can be detected that the retainer 36 has not moved to the full locking position yet.

The retainer 36 is also provided with the detection protrusions 41. With the retainer 36 located at the partial locking position, the detection protrusions 41 interfere with the male connector M in the process of connecting the male housing 10 to the male connector M. With the retainer 36 located at the full locking position, the detection protrusions 41 do not interfere with the male connector M. According to this configuration, at which of the partial locking position and the full locking position the retainer 36 is located can be detected in connecting the female housing 10 to the male connector M.

Other Embodiments

The present invention is not limited to the above described and illustrated embodiment, but is represented by claims. The present invention is intended to include all changes in the meaning of equivalents to claims and in the scope of claims and also include the following embodiments.

(1) Although the hooking portion has both the function of holding the retainer at the partial locking position and the function of holding the retainer at the full locking position in the above embodiment, the hooking portion may have only the function of holding the retainer at the partial locking position, may have only the function of holding the retainer at the full locking position or may not have any function of holding the retainer at either one of the partial locking position and the full locking position.

(2) Although the retainer retains the terminal fitting inside the terminal accommodation chamber in the above embodiment, the retainer may retain the terminal fitting in an opening on the rear end of the terminal accommodation chamber.

(3) Although the secondary locking portion of the terminal fitting projects into the cut portion in the above embodiment, the secondary locking portion may not project into the cut portion.

(4) Although the cut portion is open in the outer surface of the housing in the above embodiment, the cut portion may not be open in the outer surface of the housing.

(5) Although the retainer includes a detector for detecting at which of the partial locking position and the full locking position the retainer is located in the above embodiment, the retainer may not include the detector.

LIST OF REFERENCE NUMERALS

F . . . female connector (connector)
M . . . male connector (mating connector)
10 . . . female housing (housing)
11 . . . terminal accommodating portion
12 . . . terminal accommodation chamber
13 . . . locking lance
14 . . . terminal insertion opening
15 . . . cut portion
16 . . . outer surface of terminal accommodation chamber
17 . . . recess
18 . . . displacement restricting portion
19 . . . partial locking holding portion (holding portion)
20 . . . common holding portion (holding portion)
21 . . . partial lock restricting portion
22 . . . lock arm
23 . . . arm body portion
24 . . . supporting portion
25 . . . operating portion
26 . . . lock projection
27 . . . female terminal fitting (terminal fitting)
28 . . . rectangular tube portion
29 . . . crimping portion

30 . . . resilient contact piece
31 . . . primary locking portion
32 . . . coated wire
33 . . . upper plate portion
34 . . . secondary locking portion
35 . . . contact portion
36 . . . retainer
37 . . . rear wall portion
38 . . . covering portion
39 . . . operation hole
40 . . . escaping portion
41 . . . detection protrusion (detector)
42 . . . retaining portion
43 . . . hooking portion
44 . . . base portion
45 . . . projection
46 . . . common fitting groove
47 . . . partial lock fitting groove
48 . . . deflection space
49 . . . male housing
50 . . . terminal penetrating portion
51 . . . receptacle
52 . . . detection receiving portion
53 . . . common fitting groove
54 . . . male terminal fitting

What is claimed is:

1. A connector, comprising:
a housing;
a terminal fitting to be inserted into the housing from behind;
a retainer mounted on the housing;
a terminal accommodation chamber formed in the housing, the terminal accommodation chamber accommodating the terminal fitting;
a cut portion formed in the housing by recessing a part of an inner wall portion of the terminal accommodation chamber; and
a retaining portion formed on the retainer,
wherein:
the retainer is movable in a direction intersecting an inserting direction of the terminal fitting between a partial locking position where insertion of the terminal fitting into the housing is allowed and a full locking position where the terminal fitting inserted into the housing is retained,
the housing is formed with a displacement restricting portion,
the retainer is formed with a hooking portion capable of coming into contact with the displacement restricting portion from front when the retainer is at the full locking position,
the retaining portion is accommodated into the cut portion when the retainer is at the partial locking position, and
the retaining portion is facing the terminal fitting to be able to come into contact with the terminal fitting from behind when the retainer is at the full locking position.

2. The connector of claim 1, wherein the hooking portion restricts a movement of the retainer by being fit to a holding portion of the housing when the retainer is at at least one of the partial locking position and the full locking position.

3. The connector of claim 1, wherein:
the terminal fitting is formed with a secondary locking portion projecting into the cut portion, and
the secondary locking portion is capable of facing the retaining portion to be able to come into contact with the retaining portion from front when the retainer is at the full locking position.

4. The connector of claim 1, comprising a lock arm disposed along an outer surface of the housing, wherein:
the lock arm is resiliently displaced toward the outer surface of the housing in the process of connection to a mating connector,
the cut portion is open to face the lock arm in the outer surface of the housing, and
the retaining portion is disposed at a position for restricting a resilient displacement of the lock arm when the retainer is at the partial locking position.

5. A connector, comprising:
a housing;
a terminal fitting to be inserted into the housing from behind; and
a retainer mounted on the housing,
wherein:
the retainer is movable in a direction intersecting an inserting direction of the terminal fitting between a partial locking position where insertion of the terminal fitting into the housing is allowed and a full locking position where the terminal fitting inserted into the housing is retained,
the housing is formed with a displacement restricting portion,
the retainer is formed with a hooking portion capable of coming into contact with the displacement restricting portion from front when the retainer is at the full locking position,
the retainer is provided with a detector,
the detector interferes with a mating connector in the process of connecting the housing to the mating connector with the retainer located at the partial locking position, and
the detector does not interfere with the mating connector with the retainer located at the full locking position.

* * * * *